US010164391B2

(12) United States Patent
Blair et al.

(10) Patent No.: US 10,164,391 B2
(45) Date of Patent: Dec. 25, 2018

(54) RETROFIT LED ADAPTER

(71) Applicant: The LED Source, Inc., San Diego, CA (US)

(72) Inventors: George R. Blair, San Diego, CA (US); Jeff R. Blair, San Diego, CA (US); James Docherty, Santee, CA (US); Brent R. Noon, Rancho Santa Fe, CA (US)

(73) Assignee: The LED Source, Inc., San Diego, CA (US)

( * ) Notice: Subject to any disclaimer, the term of this patent is extended or adjusted under 35 U.S.C. 154(b) by 0 days.

(21) Appl. No.: 15/684,534

(22) Filed: Aug. 23, 2017

(65) Prior Publication Data

US 2018/0219340 A1 Aug. 2, 2018

Related U.S. Application Data

(60) Provisional application No. 62/451,568, filed on Jan. 27, 2017.

(51) Int. Cl.

| | |
|---|---|
| ***H01R 31/06*** | (2006.01) |
| ***F21V 23/02*** | (2006.01) |
| ***F21V 23/06*** | (2006.01) |
| ***H01R 13/622*** | (2006.01) |
| ***H01R 13/66*** | (2006.01) |

(Continued)

(52) U.S. Cl.

CPC ..... *H01R 31/06* (2013.01); *F21V 23/02* (2013.01); *F21V 23/06* (2013.01); *H01R 13/622* (2013.01); *H01R 13/665* (2013.01); *H01R 31/065* (2013.01); *H01R 2103/00* (2013.01); *H01R 2107/00* (2013.01)

(58) Field of Classification Search

CPC .... H01R 31/06; H01R 13/622; H01R 13/665; H01R 31/065; H01R 2103/00; H01R 2107/00; F21V 23/02; F21V 23/06

See application file for complete search history.

(56) References Cited

U.S. PATENT DOCUMENTS 7,125,159 B2 * 10/2006 Hirsch ..... H01R 33/0809 362/222

7,258,572 B2 * 8/2007 Milan ..... H01R 31/02 307/119

(Continued)

OTHER PUBLICATIONS

International Search Report and Written Opinion dated Dec. 11, 2017, PCT/US17/54541.

*Primary Examiner* — Edwin A. Leon

(74) *Attorney, Agent, or Firm* — Kelly & Kelley, LLP

(57) ABSTRACT

An LED adapter to retrofit non-LED light fixtures to accept LED lights without electrical rewiring. The LED adapter includes a multi-use base plug that is configured to connect to the socket on the non-LED light fixture and a universal LED plug configured to connect to the socket on an LED light. The multi-use base plug may be a four-pin square base, a two-pin (aligned or off-set) square base, a two-pin tombstone base, a two-pin oval base, or a threaded base. The adapter may also include a power regulator disposed between the universal LED plug and the multi-use base plug. The power regulator includes one or more resistor to adjust the current or voltage supplied by the non-LED light fixture so as to be compatible with the LED light fixture.

20 Claims, 15 Drawing Sheets

(51) Int. Cl.
*H01R 103/00* (2006.01)
*H01R 107/00* (2006.01)

(56) References Cited

U.S. PATENT DOCUMENTS

| | | | | |
|---|---|---|---|---|
| 8,118,449 | B2 * | 2/2012 | Pawelko | F21S 8/033 362/249.02 |
| 8,154,179 | B2 * | 4/2012 | Chen | F21V 19/001 313/46 |
| 8,376,606 | B2 * | 2/2013 | Yu | F21V 17/06 362/652 |
| 9,557,022 | B2 * | 1/2017 | Araki | F21S 8/026 |
| 2013/0163254 | A1 | 6/2013 | Chang et al. | |
| 2015/0362159 | A1 | 12/2015 | Ludyjan | |
| 2016/0320007 | A1 | 11/2016 | Araki | |
| 2017/0311399 | A1 | 10/2017 | Shah et al. | |

* cited by examiner

RETROFIT LED ADAPTER

RELATED APPLICATION

This application claims the benefit of U.S. Provisional Application No. 62/451,568, filed on Jan. 27, 2017.

BACKGROUND OF THE INVENTION

The present invention is directed to an adapter for use with existing light fixtures to facilitate retrofitting of the same. More particularly, the present invention is directed to an adapter that allows for the retrofitting of existing incandescent, florescent, or halogen light fixtures with a universal LED light fixture without having to remove the existing housing.

Presently, if one desires to retrofit existing light fixtures to work with LED bulbs the light fixture, including the housing, must be removed and replaced in order to accept the apparatus that can accept the LED light fixture. Existing incandescent, florescent, and halogen light fixtures tend to have different bases and plugs such that there is no universal LED replacement for the various types of light fixtures.

Accordingly, there is a need for a device or system that allows existing incandescent, florescent, or halogen light fixtures to be retrofitted to accept LED bulbs. Such retrofitting is preferably done in a way such that it can be accomplished with minimal removal and replacement of existing light fixtures. The present invention fulfills these needs and provides other related advantages.

SUMMARY OF THE INVENTION

The present invention is directed to an LED adapter for retrofitting a non-LED light fixture. The LED adapter includes a universal LED plug electrically connected to a multi-use base plug. The universal LED plug is configured for operative connection to an LED light fixture. The multi-use base plug is configured for operative connection to the non-LED light fixture. In this way, the LED light fixture can be connected to an existing non-LED light fixture without having to remove the non-LED light fixture or otherwise performing any electrical rewiring.

The multi-use base plug is configured to be adaptable to various forms of sockets on non-LED light fixtures. In one embodiment, the multi-use base plug might include a four-pin square base plug configured for connection to a socket on the non-LED light fixture. In a second embodiment, the multi-use base plug might include a two-pin aligned square base plug configured for connection to a socket on the non-LED light fixture. In a third embodiment, the multi-use base plug might include a two-pin off-set square base plug configured for connection to a socket on the non-LED light fixture. In a fourth embodiment, the multi-use base plug might include a two-pin tombstone square base plug configured for connection to a socket on the non-LED light fixture. In a fifth embodiment, the multi-use base plug might include a two-pin oval base plug configured for connection to a socket on the non-LED light fixture. In a sixth embodiment, the multi-use base plug might include a screw thread base plug configured for connection to a socket on the non-LED light fixture.

The LED adapter may further include a power regulator electrically disposed between the universal LED plug and the multi-use base plug. The power regulator is configured to adjust the current or voltage from the non-LED light fixture so as to be compatible with the LED light fixture. In a particular embodiment, the power regulator includes one or more resistors to adjust the current or voltage from an electrical ballast on the non-LED light fixture so as to be compatible with an internal LED driver on the LED light fixture.

The present invention is also directed to a process for retrofitting a non-LED light fixture with and LED light fixture. The process includes providing an LED adapter having a universal LED plug electrically connected to a multi-use base plug. The universal LED plug is configured for operative connection to an LED light fixture and the multi-use base plug is configured for operative connection to the non-LED light fixture. The multi-use base plug is connected to a socket on the non-LED light fixture and the universal LED plug is attached to the LED light fixture. The power delivered from the non-LED light fixture is regulated so as to be compatible with an internal LED driver on the LED light fixture.

In one embodiment, the regulating step includes bypassing an electrical ballast on the non-LED light fixture. In another embodiment, the regulating step includes adjusting the current or voltage from the non-LED light fixture. The LED adapter might include a power regulator disposed between the universal LED plug and the multi-use base plug. In this case, the power regulator performs the regulating step. The power regulator preferably includes one or more resistors to regulate the power delivered from the non-LED light fixture.

Providing the LED adapter may include assembling the multi-use base plug. Such assembly includes assembling a multi-use base plate with a configuration of pins compatible with the socket on the non-LED light fixture. Electrical wires from the universal LED plug are then passed through openings on a multi-use housing cap. The electrical wires from the universal LED plug are then connected to the pins assembled on the multi-use base plate. The multi-use housing cap is then secured to the multi-use base plate.

This process may also include injecting an insulating material into the multi-use housing cap after it is secured to the multi-use base plate. The process may also include electrically connecting an equalizing circuit board enclosed within the multi-use housing cap to the electrical wires.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
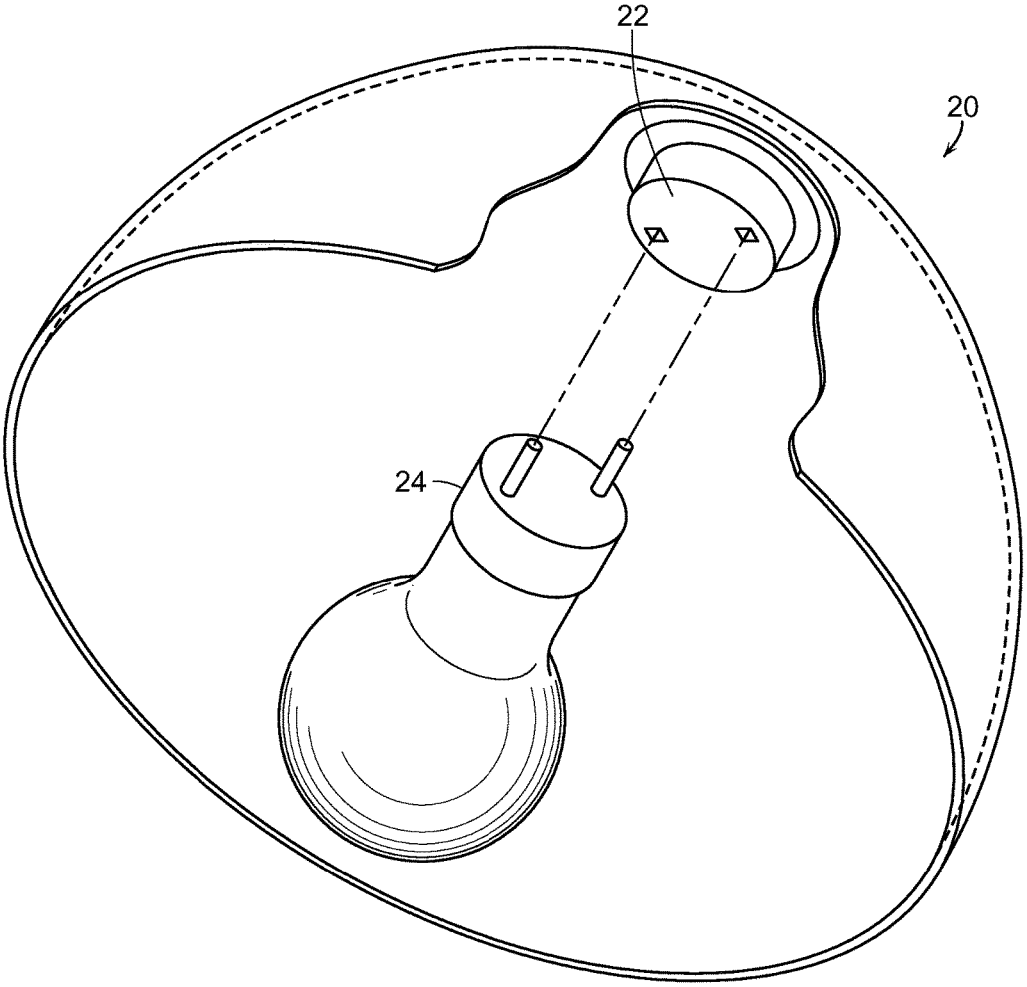
FIG. 1 PRIOR ART
FIG. 1 depicts the interior of a prior art, two-prong halogen light fixture.

The present invention is directed to an adapter for use with non-LED light fixtures. In particular, the present invention is directed to such an adapter that would allow for the use of LED lights with existing non-LED light fixtures without requiring replacement or rewiring of the non-LED light fixture. In the following figures, the inventive LED adapter is generally referred to by reference numeral 10.

As shown in FIGS. 8-12, the LED adapter 10 generally comprises a multi-use base plug 12 and a universal LED plug 14 connected by electrical wires 16.

FIGS. 1-7 illustrate prior art light fixtures intended to be retrofit using the adapter of the present invention. FIGS. 1-5 illustrate prior art light fixtures 20 using incandescent, halogen, compact florescent or similar bulbs for which the sockets are compatible with the LED adapter 10 in a retrofit. The prior art light bulb can have variously configured plugs, including threaded bases on incandescent bulbs, multiple types of plugs for florescent bulbs (both compact and non-compact), and multi-prong plugs for halogen light fixtures. Presently, if anyone seeks to replace one of these prior art incandescent, florescent, or halogen light fixtures with an LED fixture, it is necessary to remove and replace the entire fixture so that the plug contained in the housing is configured to accept the LED bulb. This is primarily the case in recessed lighting fixtures, but is also a problem in other forms of light fixtures.

Figure 2:
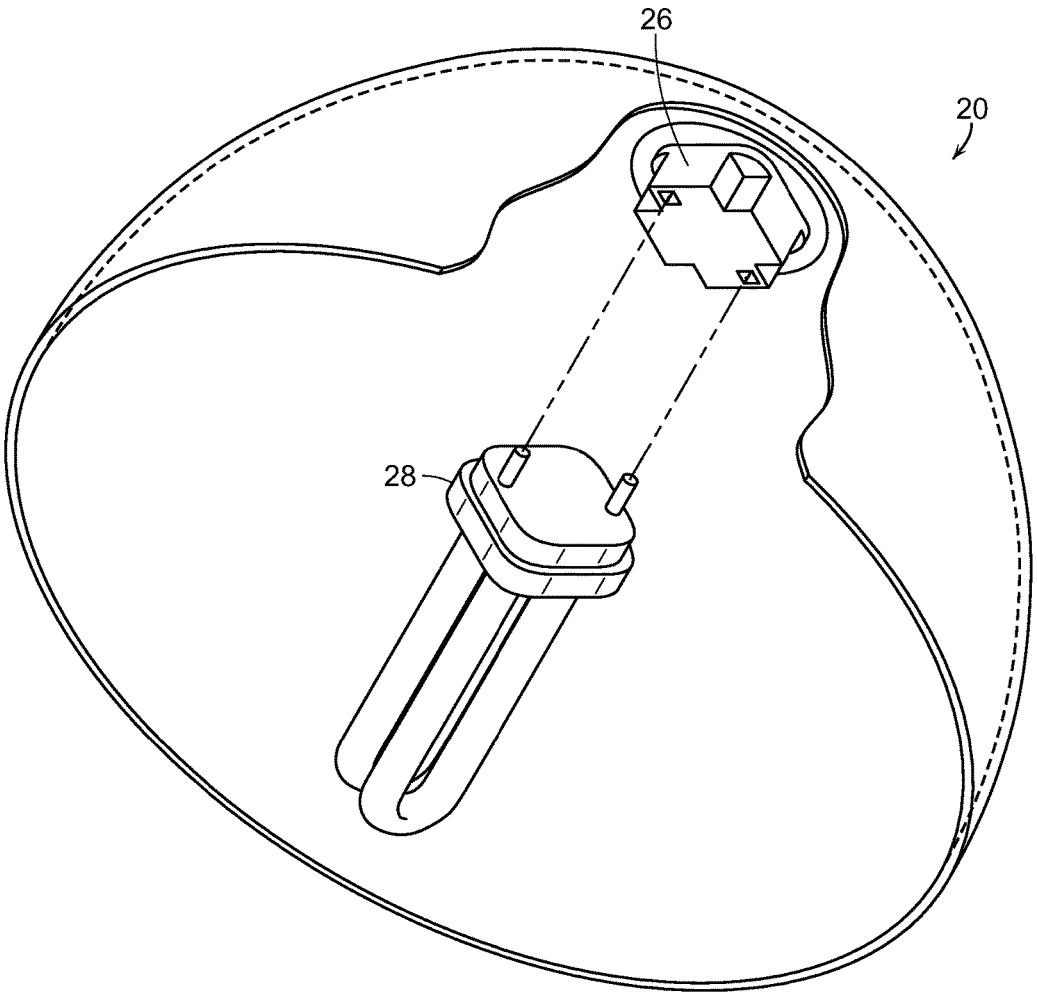
FIG. 2 PRIOR ART
FIG. 2 depicts the interior of a prior art, two-pin florescent light fixture.
Figure 3:
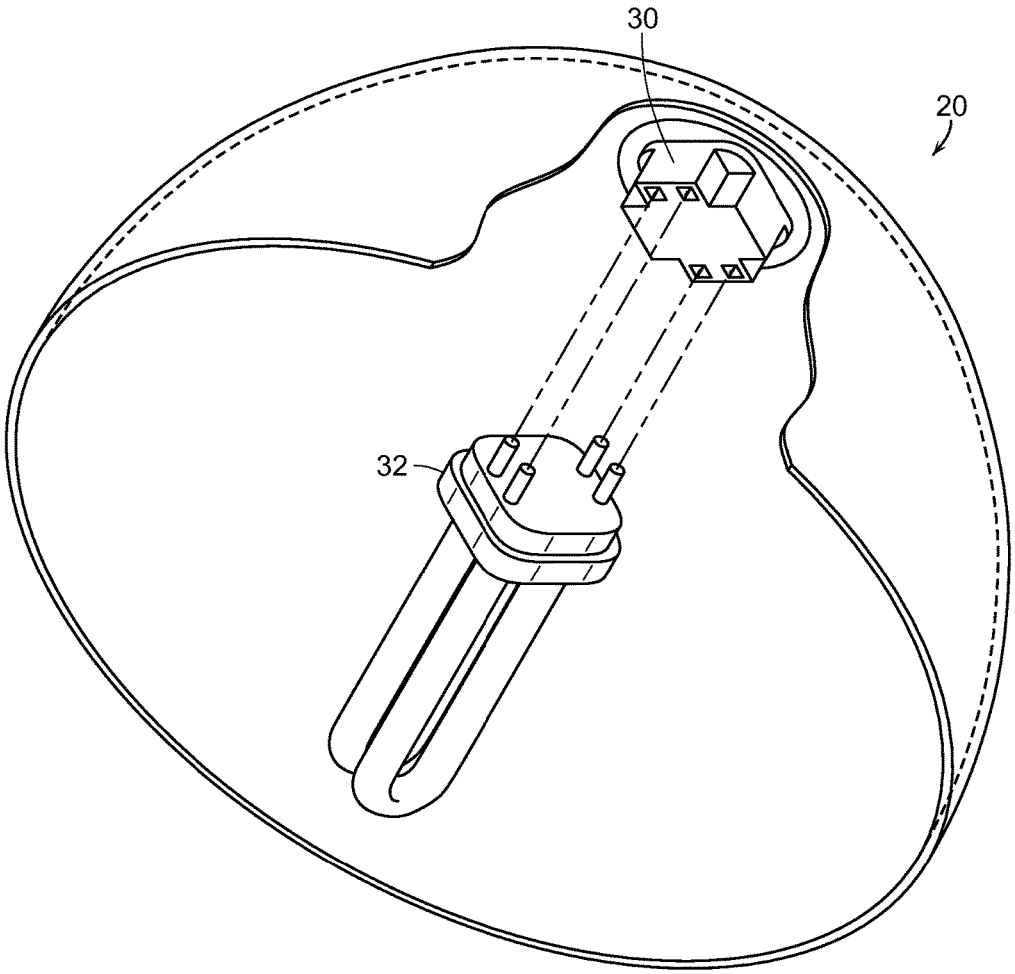
FIG. 3 PRIOR ART
FIG. 3 depicts the interior of a prior art, four-pin florescent light fixture.
Figure 4:
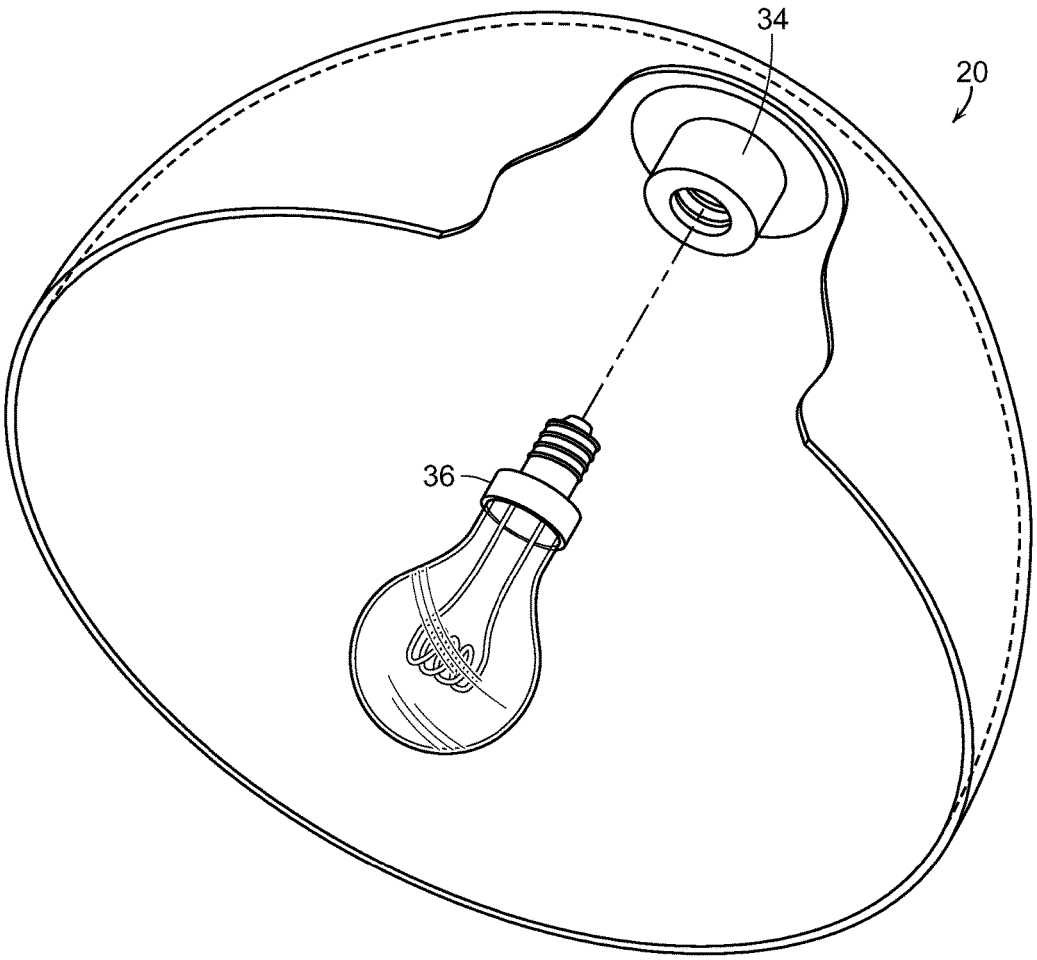
FIG. 4 PRIOR ART
FIG. 4 depicts the interior of a prior art, threaded base light fixture.
Figure 5:
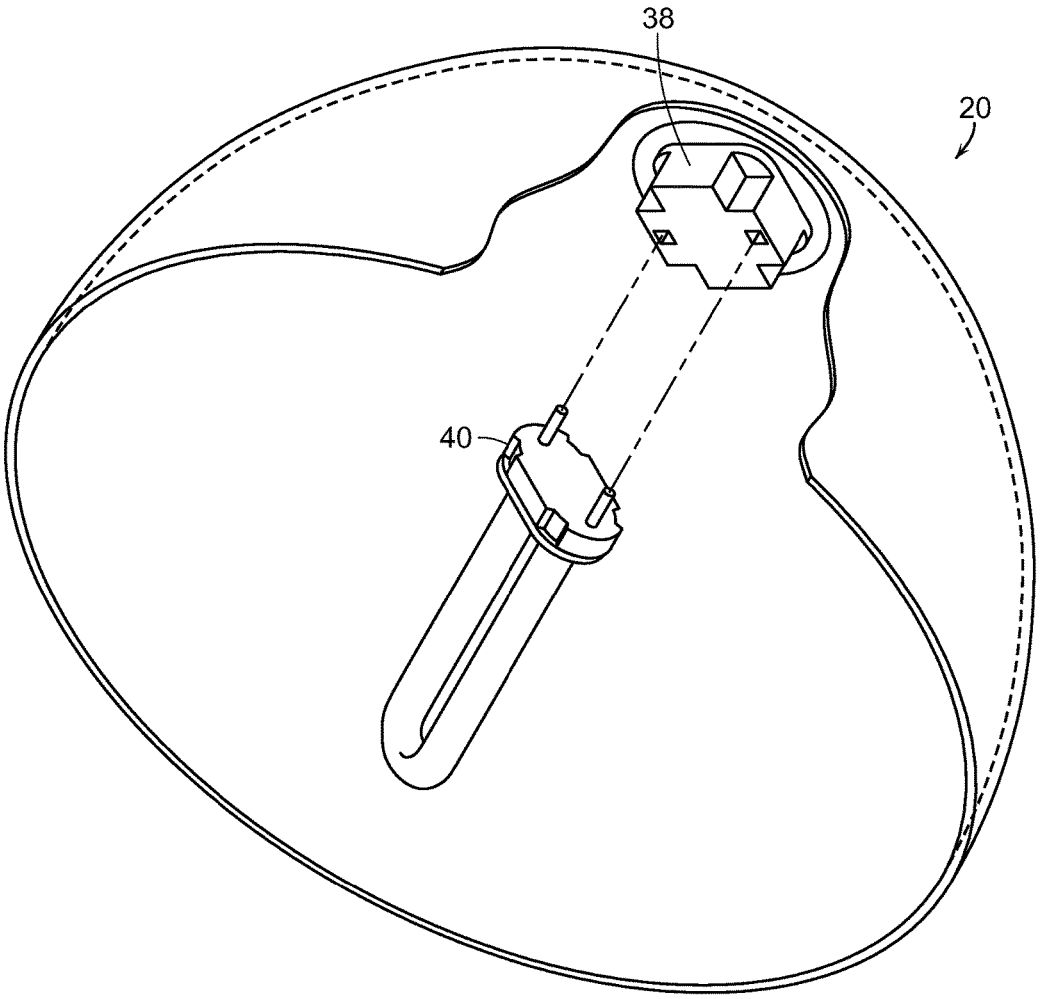
FIG. 5 PRIOR ART
FIG. 5 depicts the interior of a prior art, two-pin, oval-base florescent light fixture.

FIG. 1 shows a light fixture 20 with a two-pin, round base 22 for a halogen or similar light bulb 24. FIG. 2 shows a light fixture 20 with an offset, two-pin, square base 26 for a halogen or similar light bulb 28. FIG. 3 shows a light fixture 20 with a four-pin, square base 30 for a halogen or similar light bulb 32. FIG. 4 shows a light fixture 20 with a threaded base 34 for an incandescent, halogen or similar light bulb 36. FIG. 5 shows a light fixture 20 with a two-pin, oval base 38 for a halogen or similar light bulb 40.

The retrofit LED adapter 10 is designed to work with any of these prior art light fixtures 20 to make the same compatible with and LED light bulb. Specifically, the applicable base plug 22, 26, 30, 34, 38 receives the multi-use base plug 12 from the inventive LED adapter 10. The universal LED plug 14 of the adapter 10 can then connected to any LED light to make the same operable with the prior art light fixture 20. Using the adapter 10 allows for retrofitting any prior art light fixture 20 without the need to replace or rewire the prior art fixture 20.

Figure 6:
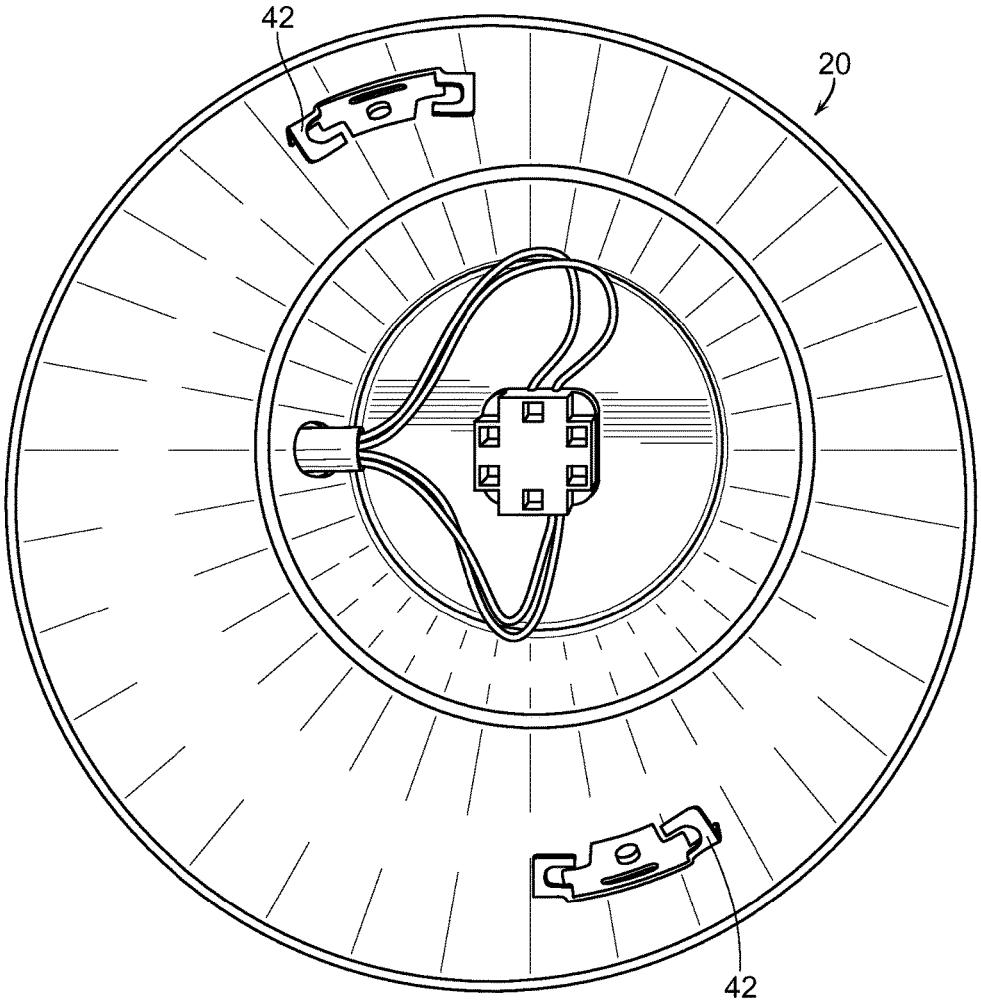
FIG. 6 PRIOR ART
FIG. 6 depicts the interior of a prior art light fixture housing showing clips for retaining a lens.

FIG. 6 shows the interior of a prior art fixture 20 including a pair of retaining clips 42 that ordinarily receive a lens or shroud for the prior art fixture 20. These retaining clips 42 or a similar mechanism within the prior art fixture 20 can be used to retain the newly retrofitted LED light (not shown) within the fixture 20. Preferably, the LED light includes spring arms (not shown) or a similar structure that can engage the retaining clips 42 so as to secure the LED light within the existing light housing 20.

Figure 7A:
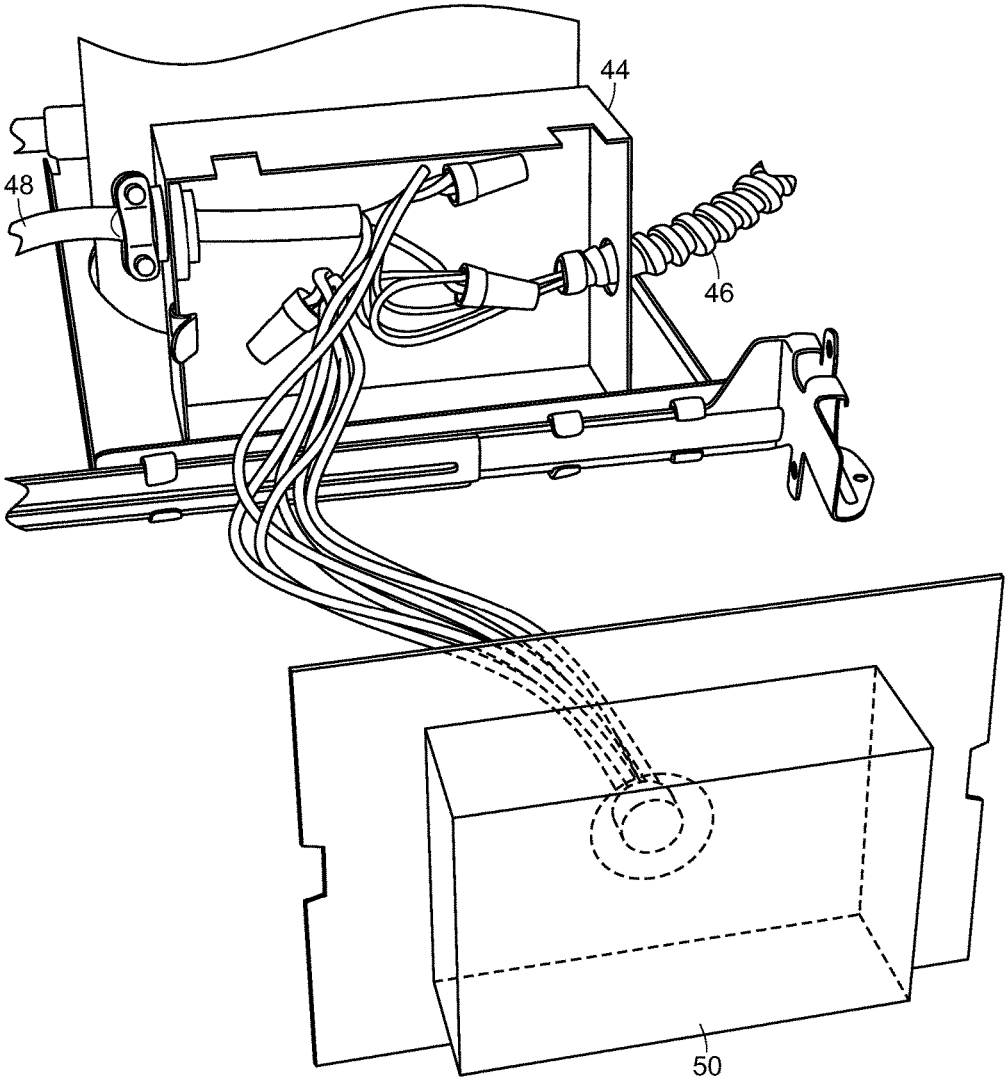
FIG. 7A PRIOR ART
FIG. 7A depicts an open ballast on a prior art light fixture.
Figure 7B:
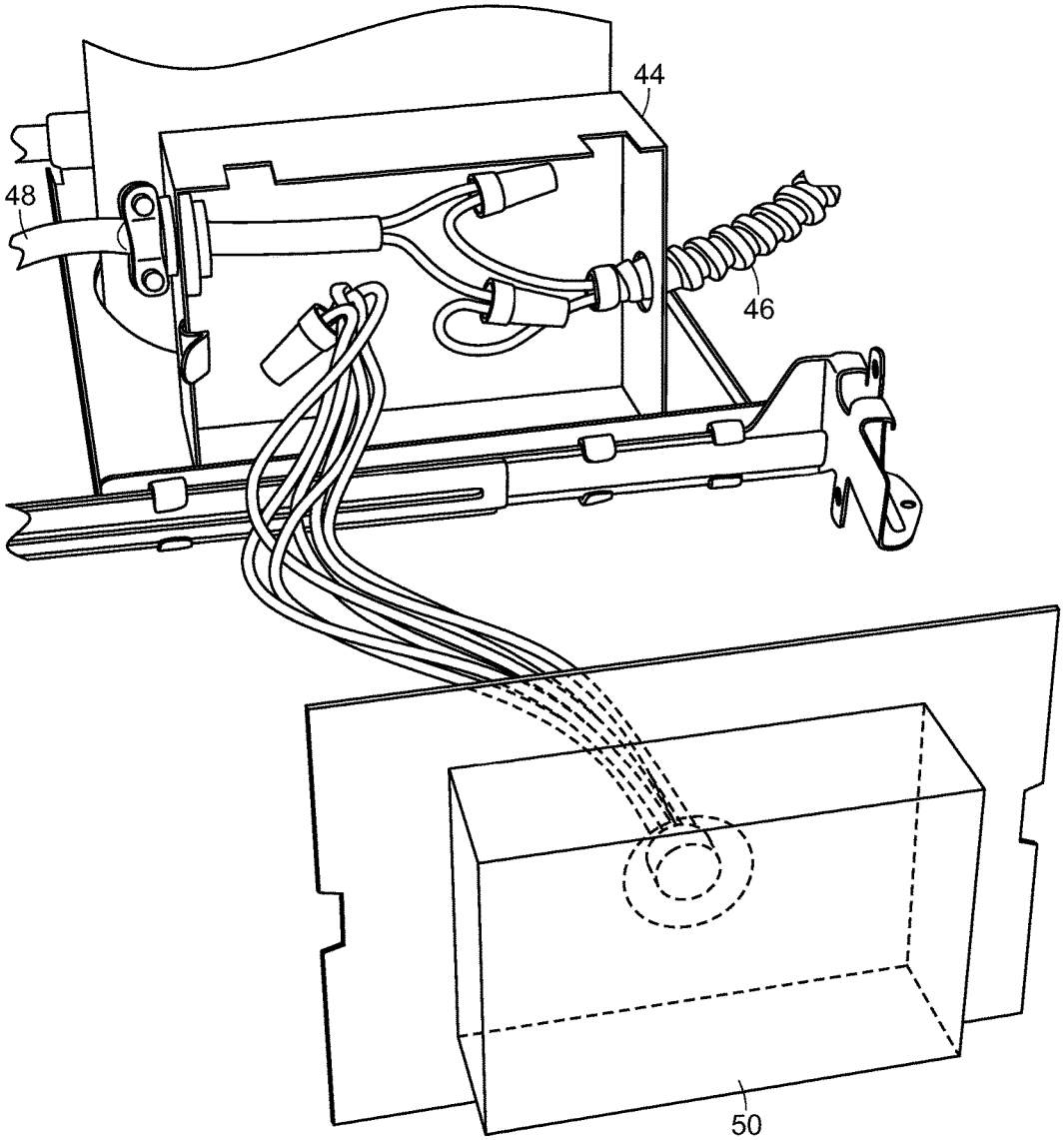
FIG. 7B depicts a modified ballast for use with the present invention.

FIGS. 7A and 7B illustrate an electrical junction box 44 for an existing light housing 20. The electrical junction box 44 provides an enclosed space where the electrical supply wires 46 can be coupled to light fixture wires 48. As shown in FIG. 7A, many prior art light fixtures 20 might require a ballast 50 or similar electrical circuit to ensure that the electricity provided by the supply wires 46 provide electricity in the proper form (AC/DC), voltage, and current. Thus, the ballast will be wired in to the junction box 44 such that the electricity provided by the supply wires 46 is first passed through the ballast 50 before being sent to the fixture wires 48.

Oftentimes, the ballast 50 of prior art light fixtures does not provide electricity in the proper form for an LED light. In that case, as shown in FIG. 7B, the ballast 50 can be disconnected from the supply wires 46 such that electricity would be directly supplied to the fixture wires 48. In As shown in FIG. 7*b*, the wires from the ballast 50 can be capped or otherwise sealed and left in the junction box 44. Alternatively, the ballast 50 can be removed completely and replaced with a blank cover (not shown) for the junction box 44.

As described, the LED adapter (or set of adapters) of the present invention has a universal LED plug 14 connected by wires 16 to a multi-use base plug 12. The multi-use base plug 12 is variously configured to interface with a prior art light fixture. The plurality of adapters 10 may be provided individually or as a kit including one or more of each variation.

Figure 8:
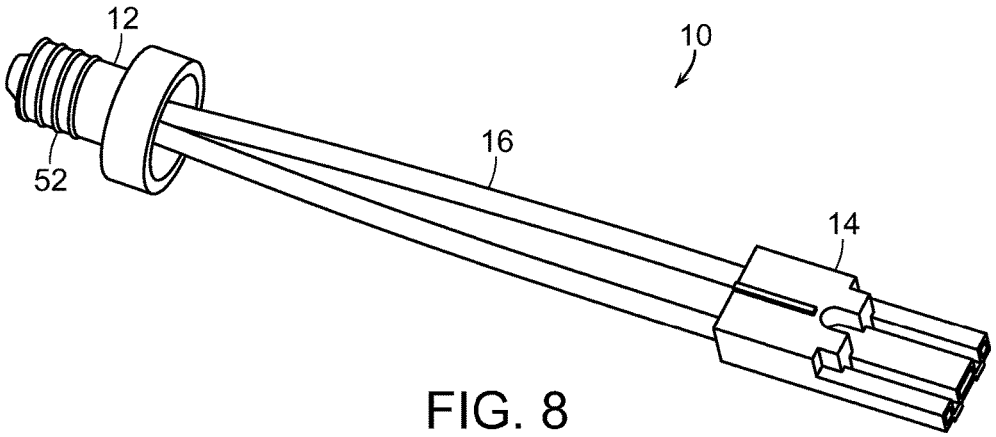
FIG. 8 depicts a perspective view of an inventive LED adapter according to the present invention having a threaded base plug.
Figure 8A:
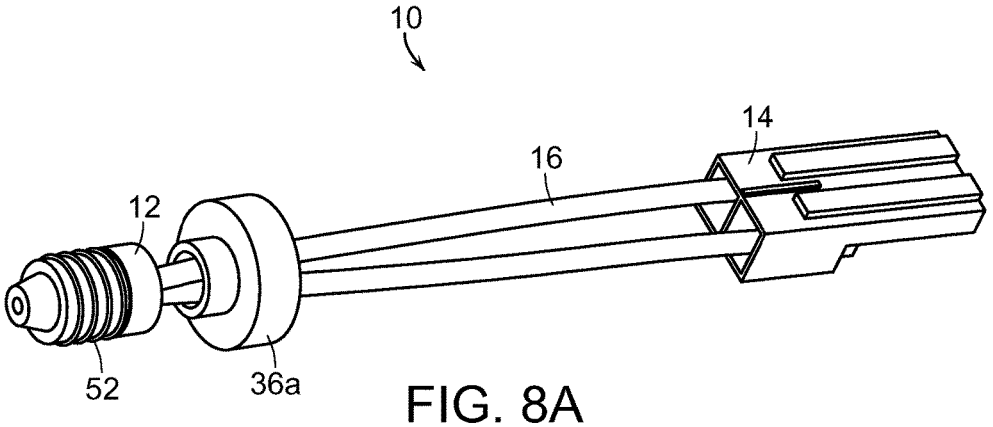
FIG. 8A depicts an alternate perspective, partially exploded view of the inventive LED adapter of FIG. 8.

FIGS. 8 and 8A depict an LED adapter 10 wherein the multi-use base plug 12 is configured with a threaded base plug 52 adapted to connect to a threaded socket 34 on a fixture as shown in FIG. 4. The electrical wires 16 (preferably one powered and one neutral) electrically connect the threaded base plug 52 to the universal LED plug 14. When the light fixture 20 supplies power to the threaded socket 34, the threaded base plug 52 receives the electricity, which is routed through the electrical wires 16 to the universal LED plug 14 and supplied to the LED light (not shown). FIG. 8A shows the threaded base plug 52 with a separable collar 36*a* that is intended to separate the electrical wires 16 with incidental contact with the socket 34 and otherwise provide a grip similar to the construction of prior art threaded bulbs 36.

Figure 9:
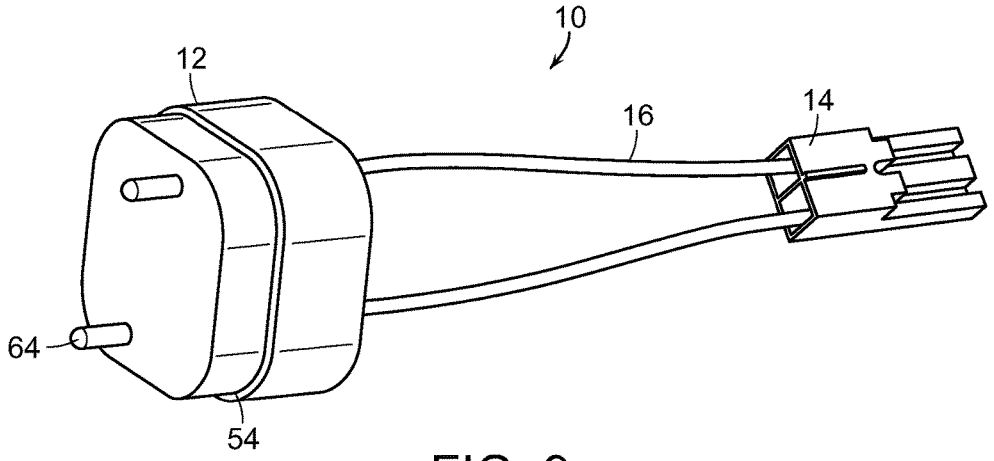
FIG. 9 depicts a perspective view of an inventive LED adapter according to the present invention having an offset, two-pin square base plug.
Figure 9A:
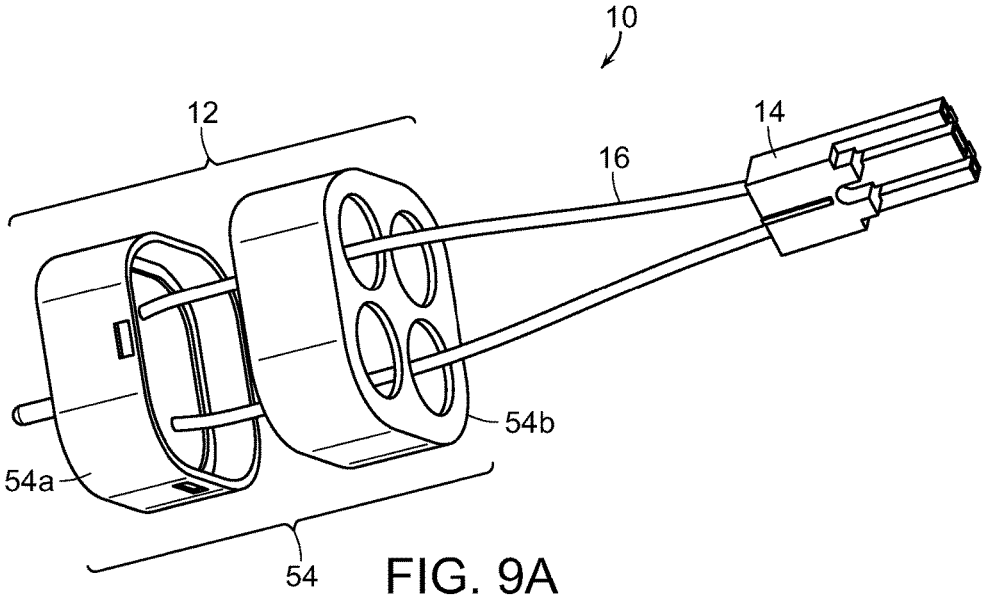
FIG. 9A depicts an alternate perspective, partially exploded view of the inventive LED adapter of FIG. 9.

FIGS. 9 and 9A depict an LED adapter 10 wherein the multi-use base plug 12 is configured with an off-set (or diagonal), two pin square base plug 54 adapted to connect to a two-pin socket 26 on a fixture as shown in FIG. 2. The electrical wires 16 (preferably one powered and one neutral) electrically connect the off-set, two pin square base plug 54 to the universal LED plug 14. When the light fixture 20 supplies power to the two-pin socket 26, the off-set, two pin square base plug 54 receives the electricity, which is routed through the electrical wires 16 to the universal LED plug 14 and supplied to the LED light (not shown). FIG. 9A shows the off-set, two pin square base plug 54 with a two-piece housing 54*a*, 54*b* that provides an assembly, as described more fully below, that is adaptable to various configurations of base plugs 12.

Figure 10:
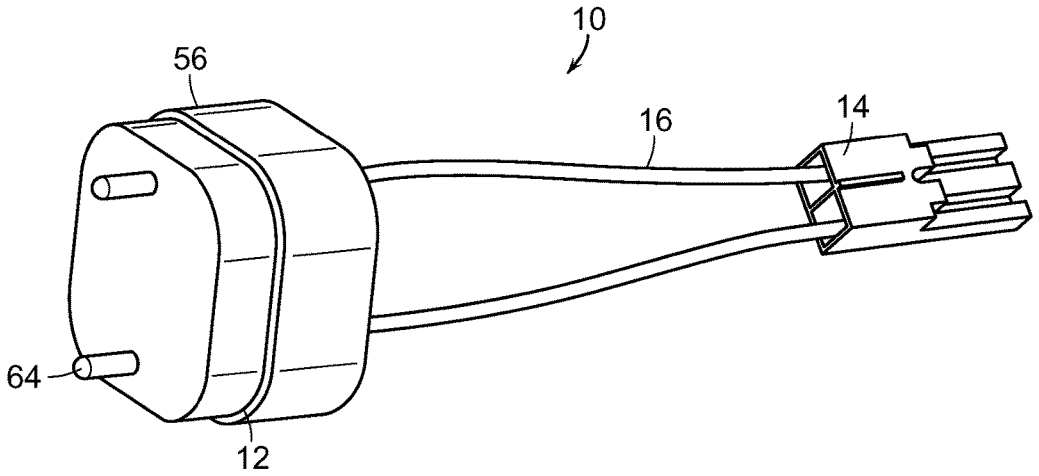
FIG. 10 depicts a perspective view of an inventive LED adapter according to the present invention having an aligned, two-pin square base plug.

FIG. 10 depicts an LED adapter 10 wherein the multi-use base plug 12 is configured with an aligned (or straight), two pin square base plug 56 adapted to connect to a two-pin socket 22, 38 on a fixture as shown in either FIG. 1 or 5. The electrical wires 16 (preferably one powered and one neutral) electrically connect the aligned, two pin square base plug 56 to the universal LED plug 14. When the light fixture 20 supplies power to the two-pin socket 22, 38, the aligned, two pin square base plug 56 receives the electricity, which is routed through the electrical wires 16 to the universal LED plug 14 and supplied to the LED light (not shown). Similar to the base plug 12 shown in FIG. 9A, this base plug 56 has an assembly, as described more fully below that is adaptable to various configurations of base plugs 12.

Figure 11:
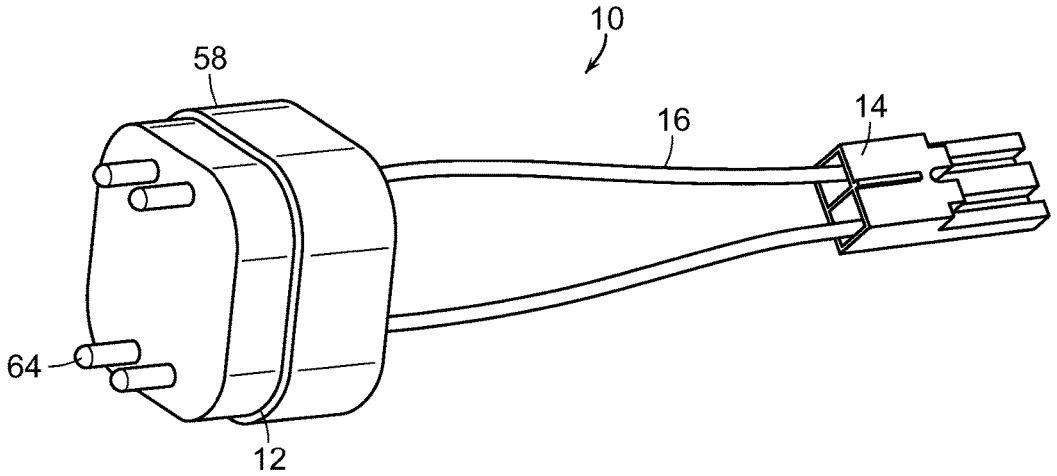
FIG. 11 depicts a perspective view of an inventive LED adapter according to the present invention having a four-pin square base plug.

FIG. 11 depicts an LED adapter 10 wherein the multi-use base plug 12 is configured with a four pin square base plug 58 adapted to connect to a four-pin socket 30 on a fixture as shown in FIG. 3. The electrical wires 16 (preferably one powered and one neutral) electrically connect the four pin square base plug 58 to the universal LED plug 14. When the light fixture 20 supplies power to the four-pin socket 30, the four pin square base plug 58 receives the electricity, which is routed through the electrical wires 16 to the universal LED plug 14 and supplied to the LED light (not shown). Similar to the base plug 12 shown in FIG. 9A, this base plug 58 has an assembly, as described more fully below that is adaptable to various configurations of base plugs 12.

Figure 12:
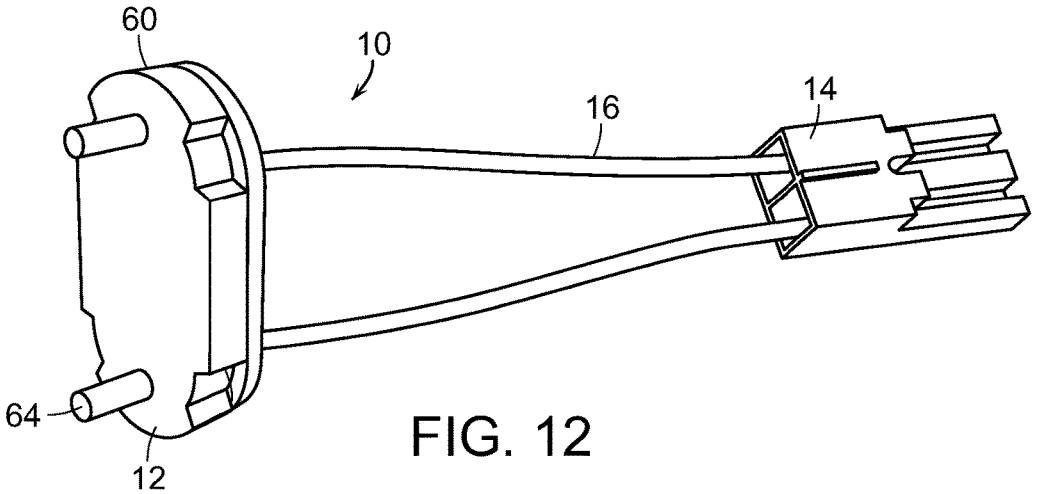
FIG. 12 depicts a perspective view of an inventive LED adapter according to the present invention having a two-pin oval base plug.

FIG. 12 depicts an LED adapter 10 wherein the multi-use base plug 12 is configured with a two pin, oval base plug 60 adapted to connect to a two-pin socket 38 on a fixture as shown in FIG. 5. The electrical wires 16 (preferably one powered and one neutral) electrically connect the two pin oval base plug 60 to the universal LED plug 14. When the light fixture 20 supplies power to the two-pin socket 38, the two pin, oval base plug 60 receives the electricity, which is routed through the electrical wires 16 to the universal LED plug 14 and supplied to the LED light (not shown). Similar to the base plug 12 shown in FIG. 9A, this base plug 60 has an assembly that can be adaptable to various configurations of base plugs 12.

Figure 13:
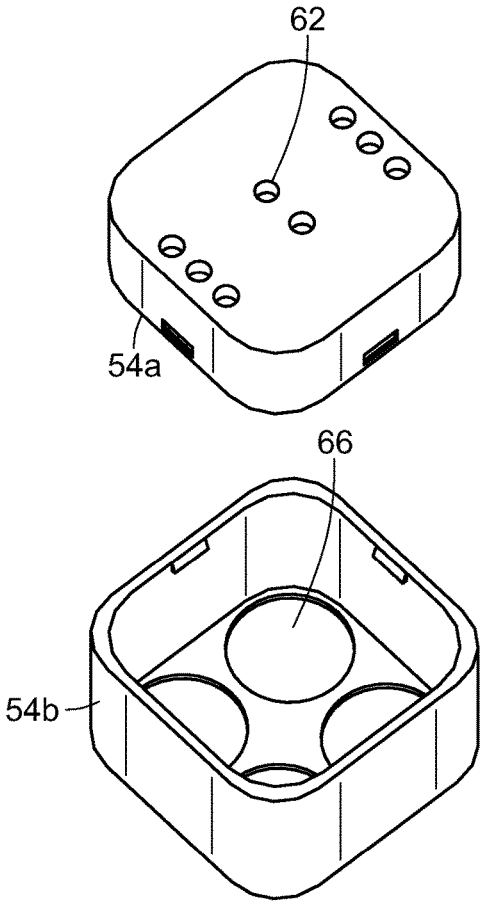
FIG. 13 depicts a perspective, exploded view of a square base plug housing for the LED adapter of the present invention.
Figure 14:
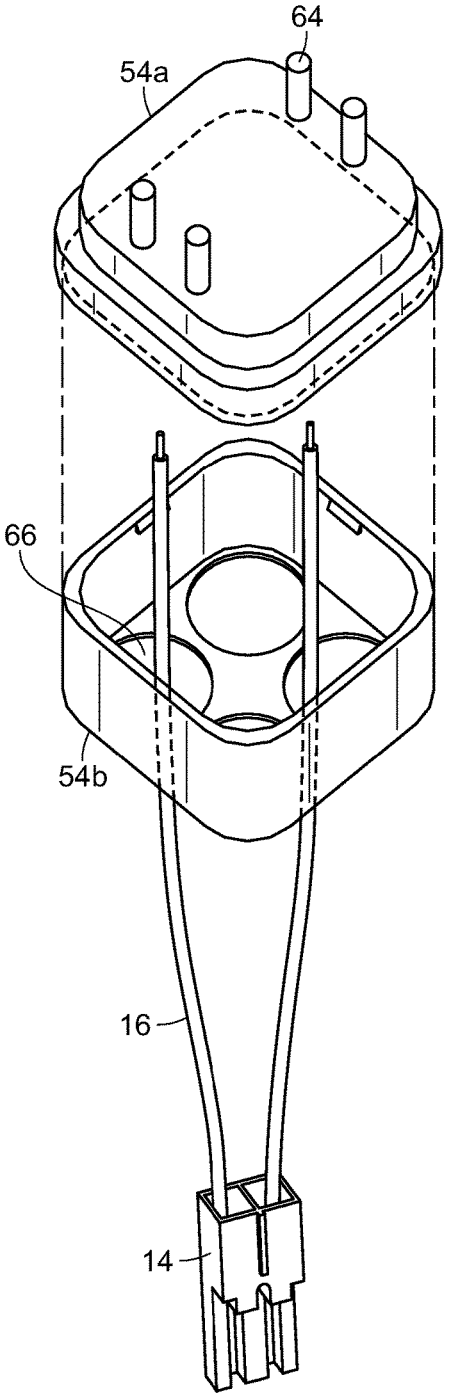
FIG. 14 depicts a partially exploded perspective view of the assembly of a multi-use base plug according to the present invention.
Figure 15:
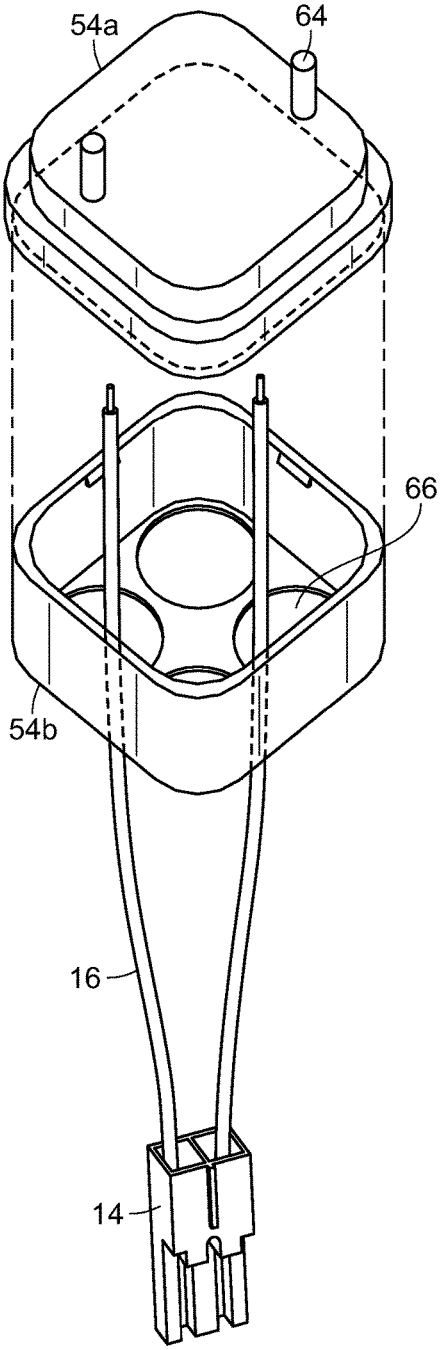
FIG. 15 depicts a partially exploded perspective view of the assembly of a multi-use base plug according to the present invention.
Figure 16:
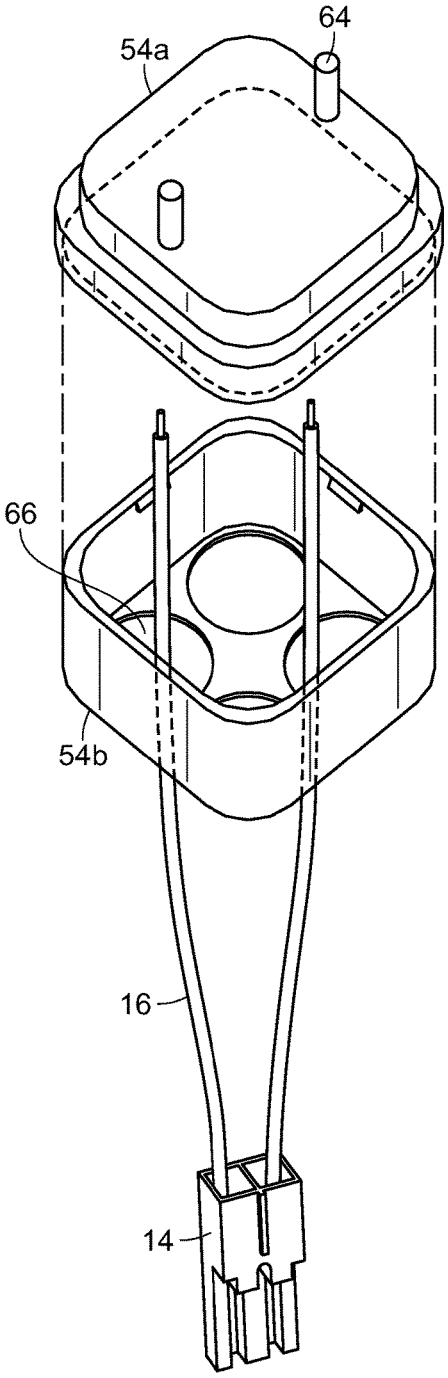
FIG. 16 depicts a partially exploded perspective view of the assembly of a multi-use base plug according to the present invention.

FIG. 13 depicts an assembly 54*a*, 54*b* for creating the various configurations of the multi-use base plug 12, particularly the square versions. The assembly 54*a*, 54*b* includes a base plate 54*a* and a housing cap 54*b*. The base plate 54*a* has a plurality of apertures 62 arranged to accommodate the various configurations of pins on the embodiments of multi-use base plugs 12. To assemble a particular multi-use base plug 12, the desired configuration of pins 64 is determined and arranged in the appropriate apertures 62. The wires 16 connected at one end to the universal LED plug 14 are passed through openings 66 on the housing cap 54*b* and connected to the appropriate pins 64. Once the housing cap 54*b* and base plate 54*a* are connected together, an insulating foam or similar material can be injected into the base plug 12 so as to secure the wires 16 and protect against electrical shorts.

Figure 17:
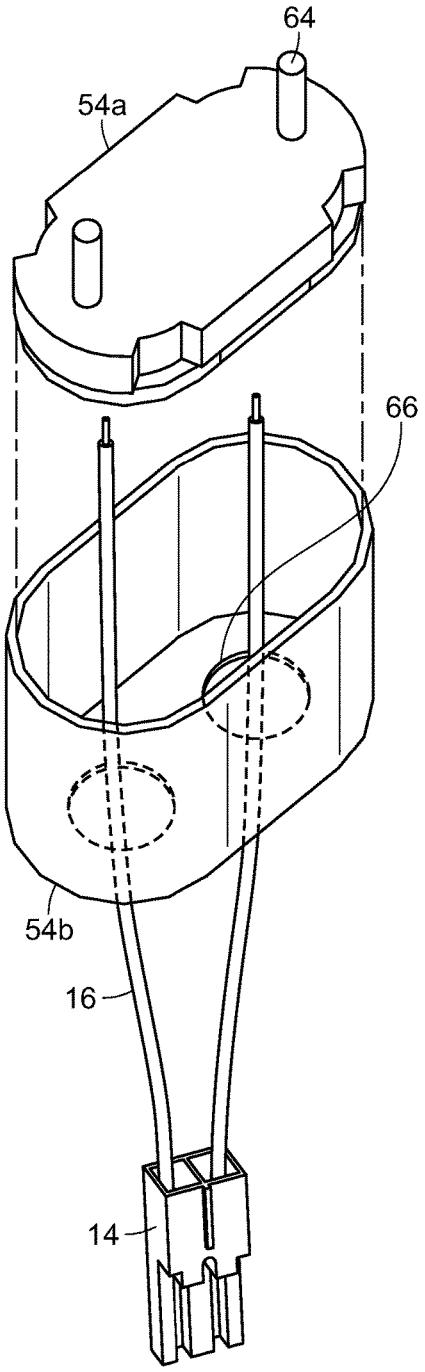
FIG. 17 depicts a partially exploded perspective view of the assembly of a multi-use base plug according to the present invention.
Figure 18:
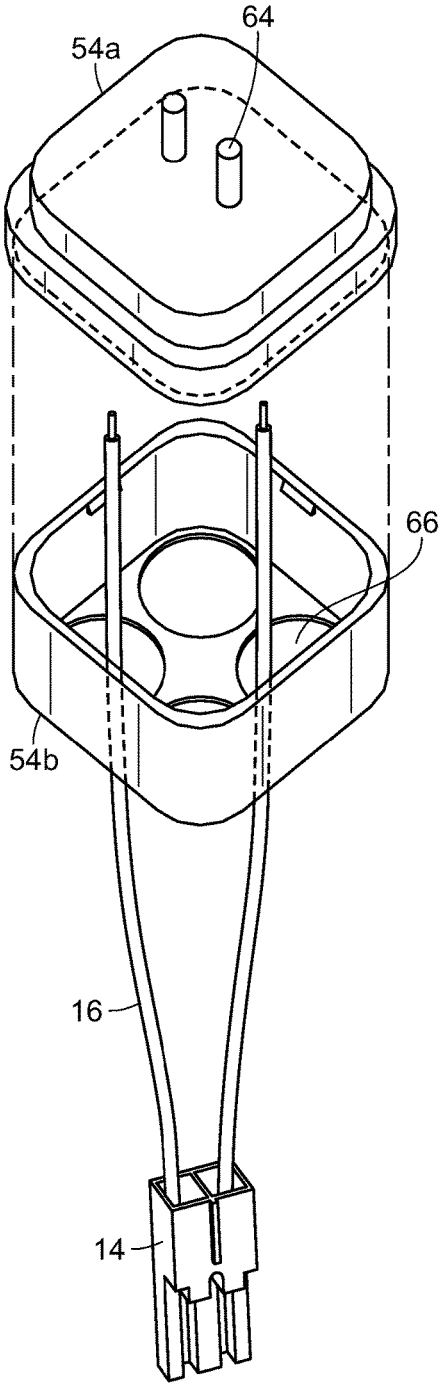
FIG. 18 depicts a partially exploded perspective view of the assembly of a multi-use base plug according to the present invention.

The apertures 62 on the base plate 54*a* are arrayed such that the four-prong, two-prong aligned, or two-prong off-set plugs can all be constructed from the same pieces depending upon how the pins 64 are configured. The top side of the housing cap 54*b* includes larger openings 66 for passage of the electrical wire 16, as well as, the introduction of the insulating material to be poured or injected therein so as to secure the multi-use base 12 together once the assembly 54*a*, 54*b* is completed. FIGS. 14-18 illustrate the assembly of various configurations of the multi-use base plugs 12. FIG. 17 illustrates that the assembly 54*a*, 54*b* can be manufactured in different shapes, yet the multi-use base 12 can still be constructed in the same manner as the square base.

Figure 19:
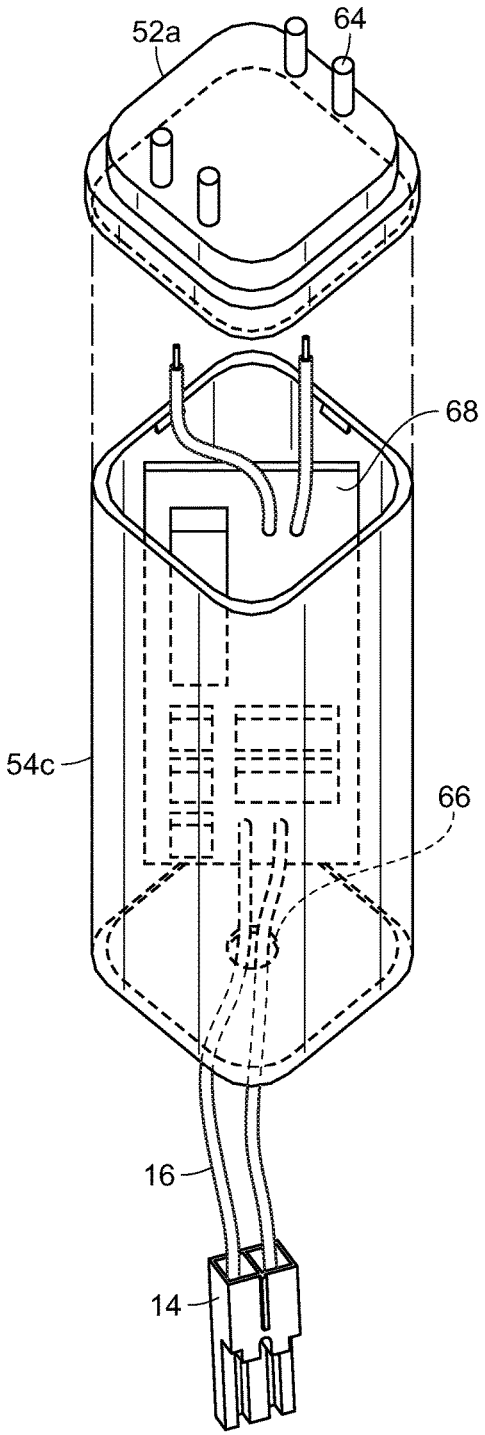
FIG. 19 depicts a partially exploded perspective view of an alternate embodiment for an LED adapter of the present invention.

FIG. 19 illustrates a variation on the assembly of the multi-use base plug 12, further including an electrical circuit 68. In this variation, the housing cap 54*b* is replaced with an elongated housing cap 54*c* configured to enclose the larger electrical circuit 68. The assembly with this variation is accomplished in a similar manner as described above with the inclusion of the circuit 68. The circuit 68 comprises a configuration of resistors and other components designed to convert the electricity supplied to the prior art light fixture 20 so that it is compatible with the LED light to which the adapter 10 is intended to be connected. A person skilled in the art will understand the appropriate configuration of resistors, capacitors, etc., that would be necessary to provide the needed voltage and current. When using this circuit 68, it may not be necessary to disconnect the wiring from a ballast 50 as described above.

A person of ordinary skill in the art will understand that in order to retrofit an existing light fixture 20, one only need remove the prior art incandescent, florescent, or halogen light bulb, insert the appropriate multi-use base 12 from the inventive adapter 10, and then connect the universal LED plug 14 to the desired LED light to be used. Depending upon the nature of the existing light fixture, i.e., recessed or surface-mounted, the LED light can have the appropriate trim or other covering to cosmetically enhance the retrofitting. Where an existing prior art light fixture 20 includes a ballast 50, the retrofitter may need to remove the ballast and/or run the electrical wires to bypass the ballast 50 such that the LED light receives the necessary electricity as supplied by the electrical wiring.

Although several embodiments have been described in detail for purposes of illustration, various modifications may be made without departing from the scope and spirit of the invention. Accordingly, the invention is not to be limited, except as by the appended claims.

What is claimed is:

1. An LED adapter for retrofitting a non-LED light fixture having a socket electrically connected to a power source, comprising:

a universal LED plug electrically connected to a multi-use base plug by elongated wires;

the universal LED plug adapted for operative connection to an LED light fixture; and the multi-use base plug comprising a base plate and a housing cap, the base plate having a plurality of apertures configured to receive a plurality of pins electrically connected to the elongated wires, the elongated wires passed through openings in the housing cap, wherein the plurality of pins on the multi-use base plug are adapted to connect to the power source through the socket on the non-LED light fixture.

2. The LED adapter of claim 1, wherein the multi-use base plug is a four-pin square base plug adapted to connect to the socket on the non-LED light fixture.

3. The LED adapter of claim 1, wherein the multi-use base plug is a two-pin aligned square base plug adapted to connect to the socket on the non-LED light fixture.

4. The LED adapter of claim 1, wherein the multi-use base plug is a two-pin off-set square base plug adapted to connect to the socket on the non-LED light fixture.

5. The LED adapter of claim 1, wherein the multi-use base plug is a two-pin tombstone square base plug adapted to connect to the socket on the non-LED light fixture.

6. The LED adapter of claim 1, wherein the multi-use base plug is a two-pin oval base plug adapted to connect to the socket on the non-LED light fixture.

7. The LED adapter of claim 1, further comprising a power regulator electrically disposed between the universal LED plug and the multi-use base plug, wherein the power regulator is adapted to adjust current or voltage from the power source through the socket on the non-LED light fixture so as to be compatible with the LED light fixture.

8. The LED adapter of claim 7, wherein the power regulator comprises one or more resistors adapted to adjust the current or voltage from the power source through an electrical ballast and the socket on the non-LED light fixture so as to be compatible with an internal LED driver on the LED light fixture.

9. An LED adapter for retrofitting a non-LED light fixture having a compact fluorescent socket electrically connected to a power source, comprising:

a universal LED plug electrically connected to a multi-use base plug by elongated wires, wherein the universal LED plug is spatially remote from the multi-use base plug by a length of the elongated wires;

the multi-use base plug comprising a base plate and a housing cap, the base plate having a plurality of apertures configured to receive a plurality of pins resembling a compact fluorescent plug adapted to operatively connect to the compact fluorescent socket contained within a housing of the non-LED light fixture, wherein the plurality of pins are electrically connected to the elongated wires passed through openings in the housing cap; and the universal LED plug adapted to operatively connect to an LED light fixture, wherein the LED light fixture is adapted to be mounted within the housing of the non-LED light fixture.

10. The LED adapter of claim 9, wherein the multi-use base plug is a four-pin square base plug adapted to connect to the compact fluorescent socket.

11. The LED adapter of claim 9, wherein the multi-use base plug is a two-pin aligned square base plug adapted to connect to the compact fluorescent socket.

12. The LED adapter of claim 9, wherein the multi-use base plug is a two-pin off-set square base plug adapted to connect to the compact fluorescent socket.

13. The LED adapter of claim 9, wherein the multi-use base plug is a two-pin tombstone square base plug adapted to connect to the compact fluorescent socket.

14. The LED adapter of claim 9, wherein the multi-use base plug is a two-pin oval base plug adapted to connect to the compact fluorescent socket.

15. The LED adapter of claim 9, further comprising a power regulator electrically disposed between the universal LED plug and the multi-use base plug, wherein the power regulator is adapted to adjust current or voltage from the power source through the compact fluorescent socket on the non-LED light fixture so as to be compatible with the LED light fixture.

16. The LED adapter of claim 15, wherein the power regulator comprises one or more resistors adapted to adjust the current or voltage from the power source through an electrical ballast and the compact fluorescent socket on the non-LED light fixture so as to be compatible with an internal LED driver on the LED light fixture.

17. The LED adapter of claim 1, wherein the multi-use base plug is a compact fluorescent plug and the socket on the non-LED light fixture is a compact fluorescent socket.

18. An LED adapter for retrofitting a non-LED light fixture having a socket electrically connected to a power source, comprising:

a universal LED plug adapted to operatively connect to an LED light fixture;

a multi-use base plug comprising a base plate and a housing cap, the base plate having a plurality of apertures configured to receive a plurality of pins resembling a plug adapted to operatively connect to the power source through the socket on the non-LED light fixture; and wherein the multi-use base plug is electrically connected to the universal LED plug by elongated wires passed through openings on the housing cap and electrically connected to the plurality of pins.

19. The LED adapter of claim 18, further comprising a power regulator electrically disposed between the universal LED plug and the multi-use base plug, wherein the power regulator is adapted to adjust current or voltage from the power source through the socket on the non-LED light fixture so as to be compatible with the LED light fixture.

20. The LED adapter of claim 19, wherein the power regulator comprises one or more resistors adapted to adjust the current or voltage from the power source through an electrical ballast and the compact fluorescent socket on the non-LED light fixture so as to be compatible with an internal LED driver on the LED light fixture.

* * * * *